US008096825B2

(12) United States Patent
Roepke

(10) Patent No.: US 8,096,825 B2
(45) Date of Patent: Jan. 17, 2012

(54) ELECTRICAL COUPLER SYSTEM AND METHOD FOR MANUFACTURE THEREOF

(75) Inventor: Jon Roepke, Hermosa Beach, CA (US)

(73) Assignee: Belkin International Inc., Playa Vista, CA (US)

( * ) Notice: Subject to any disclaimer, the term of this patent is extended or adjusted under 35 U.S.C. 154(b) by 307 days.

(21) Appl. No.: 12/411,314

(22) Filed: Mar. 25, 2009

(65) Prior Publication Data

US 2010/0248532 A1 Sep. 30, 2010

(51) Int. Cl.
*H01R 11/00* (2006.01)

(52) U.S. Cl. ..... 439/504; 429/633; 429/677; 429/956

(58) Field of Classification Search ..... 439/504, 439/633, 677, 679, 715, 956
See application file for complete search history.

(56) References Cited

U.S. PATENT DOCUMENTS 3,794,957 A * 2/1974 Winkler ..... 439/295
4,555,451 A * 11/1985 Harrod et al. ..... 429/1
4,846,701 A 7/1989 Hayes et al.
4,885,524 A * 12/1989 Wilburn ..... 320/105
5,083,944 A 1/1992 Self, Jr.
5,208,117 A 5/1993 Uemichi et al.
5,214,368 A * 5/1993 Wells ..... 320/105
5,367,243 A * 11/1994 Wells et al. ..... 320/105
5,741,305 A * 4/1998 Vincent et al. ..... 607/5
5,960,540 A 10/1999 Pentz
6,215,080 B1 4/2001 Mori et al.
6,343,949 B1 * 2/2002 Floyd ..... 439/504
6,521,370 B1 2/2003 Takeshita
6,589,069 B1 7/2003 Liao
6,821,670 B2 11/2004 Hsueh
6,850,412 B2 * 2/2005 Peter ..... 361/736
6,869,309 B2 * 3/2005 Ziegler et al. ..... 439/504
7,112,102 B2 9/2006 Masaki et al.
7,223,494 B2 5/2007 Takeshita
7,749,029 B1 * 7/2010 Pontillo, II ..... 439/678
2002/0132519 A1 * 9/2002 Ziegler et al. ..... 439/504
2010/0248532 A1 * 9/2010 Roepke ..... 439/504
2010/0291807 A1 * 11/2010 Knoerrchen et al. ..... 439/715

OTHER PUBLICATIONS

International Search Report for Application No. PCT/US2010/028758, dated Mar. 25, 2009.

* cited by examiner

*Primary Examiner* — James Harvey
(74) *Attorney, Agent, or Firm* — Bryan Cave LLP

(57) ABSTRACT

In one embodiment, a coupler system is configured to couple to electrical terminals of a battery. The coupler system comprises a coupler bridge comprising a first section, where the first section comprises a first height and a first edge. The coupler system also comprises a second section adjacent to the first section and opposite the first edge, a first coupler coupled to the second section of the coupler bridge, and a second coupler coupled to the second section of the coupler bridge. The first section of the coupler bridge is configured to restrict the first and second couplers from being electrically coupled to the electrical terminals of the battery when the first edge faces towards the battery. Other embodiments are also disclosed herein.

29 Claims, 3 Drawing Sheets

ELECTRICAL COUPLER SYSTEM AND METHOD FOR MANUFACTURE THEREOF

TECHNICAL FIELD

This disclosure relates generally to coupler systems, and relates more particularly to electrical coupler systems and methods for manufacture of electrical connector systems.

BACKGROUND

Many current electrical devices are designed to operate with power supplied from a battery, where a coupling needs to exist between the power terminals of the battery and the power terminals of the electrical device in order for the electrical device to draw power from the battery. The coupling must account for the correct polarity of the different power terminals. For example, the positive power terminal of the battery must be connected to the positive power terminal of the electric device, while the negative power terminal of the battery must be connected to the negative power terminal of the electric device. An incorrect coupling that reverses the respective polarities of the power terminals could create a dangerous condition or damage the electrical device.

For some electrical devices, the battery can be pre-coupled to the electrical device during the manufacturing process. As an example, an uninterruptible power supply can be manufactured with a pre-coupled battery. In some situations, however, the electrical device can outlast the life of the battery, even if the battery is rechargeable, such that an end user might have to couple a replacement battery to the power terminals of the electric device. This normally requires the user to disconnect and reconnect one at a time at least the positive and negative power terminals of the battery and the electrical device. In such situations, a potential for damage exists if the user were to install the replacement battery incorrectly, such as by coupling terminals of opposite polarity together. A similar situation can also happen during the manufacturing process if the coupling were made by factory workers. These situations can become even more dangerous if the electrical device is coupled to a main power source while the replacement battery is installed because the user could be shocked if he incorrectly installed the replacement battery, and/or if he directly contacted the power terminals of the electric device.

Accordingly, a need exists for an electrical coupler system that restricts a battery from being coupled to an electrical device when the polarities of the respective power terminals of the battery and the electrical device are not properly aligned.

BRIEF DESCRIPTION OF THE DRAWINGS

The invention will be better understood from a reading of the following detailed description of examples of embodiments, taken in conjunction with the accompanying figures in the drawings in which.

Figure 1:
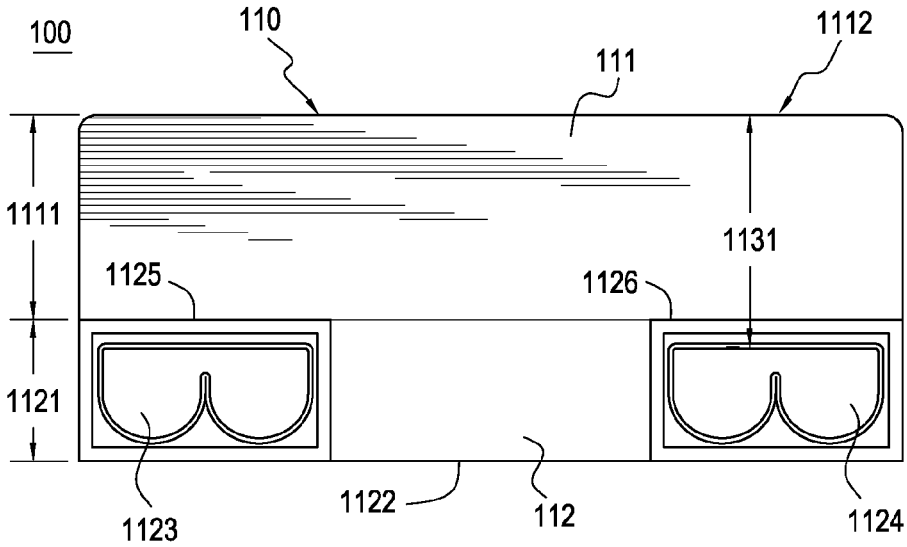
FIG. 1 illustrates a front view of a coupler bridge of a coupler system.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of examples of embodiments. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein.

The terms "couple," "coupled," "couples," "coupling," and the like should be broadly understood and refer to connecting two or more elements, mechanically or otherwise. Coupling may be for any length of time, e.g., permanent or semi-permanent or only for an instant. The absence of the word "removably," "removable," and the like near the word "coupled," and the like does not mean that the coupling, etc. in question is or is not removable.

DETAILED DESCRIPTION OF EXEMPLARY EMBODIMENTS

In one embodiment, a coupler system is configured to couple to electrical terminals of a battery. The coupler system comprises a coupler bridge comprising a first section, where the first section comprises a first height and a first edge. The coupler system also comprises a second section adjacent to the first section and opposite the first edge, a first coupler coupled to the second section of the coupler bridge, and a second coupler coupled to the second section of the coupler bridge. The first section of the coupler bridge is configured to restrict the first and second couplers from being electrically coupled to the electrical terminals of the battery when the first edge faces towards the battery.

In one example, a method of manufacturing an electrical connector for a target terminal range of a battery can comprise forming a connector body. The connector body can comprises a first segment and a second segment substantially parallel to the first segment along a length of the connector body. The method can further comprise coupling a first interface to the second segment of the connector body, and coupling a second interface to the second segment of the connector body.

Another embodiment of a battery connector mechanism for coupling with electrical terminals of a battery can comprise a structure with a first section comprising a first border along a first dimension of the structure, and a second section adjacent to the first section and opposite the first border along the first dimension of the structure. The structure can also comprise a first connector coupled to a $1^{st}$ portion of the second section of the structure and a second connector coupled to a $2^{nd}$ portion of the second section of the structure. The second section can be configured to align the first and second connectors in an un-connectable position relative to the electrical terminals of the battery when the first border contacts the battery.

Figure 2:
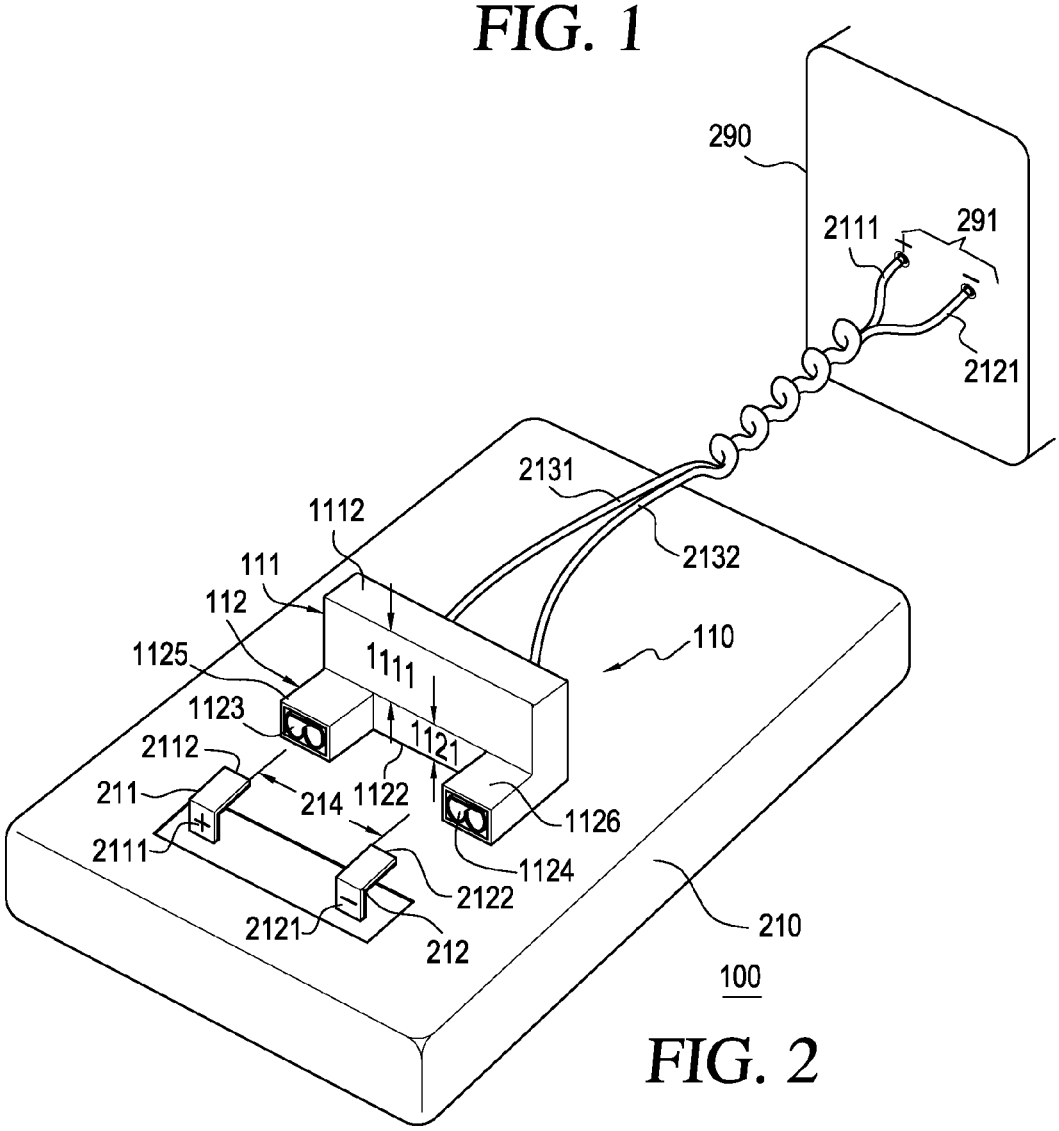
FIG. 2 illustrates a top, side, front isometric view of the coupler bridge of FIG. 1 aligned to couple with a battery.

Turning to the drawings, FIG. 1 illustrates a front view of coupler bridge 110 of coupler system 100. In some embodiments, coupler system 100 can be referred to as a battery connector mechanism and/or as an electrical connector. FIG. 2 illustrates a top, side, front isometric view of coupler bridge 110 of coupler system 100 aligned to couple with battery 210.

Coupler system 100 is configured to couple to electrical terminals of a battery (e.g., battery 210 in FIG. 2) via coupler bridge 110. FIGS. 1-2 show coupler bridge 110 comprising section 111, where section 111 has height 1111 and edge 1112. Coupler bridge 110 also comprises section 112 adjacent to section 111 and opposite edge 1112. In the present embodiment, sections 111 and 112 are adjacent to each other along a length of coupler bridge 110. Also in the present embodiment, section 112 is shown comprising height 1121 and edge 1122. In a different embodiment, sections 111 and 112 can be adjacent to each other for less than the full length of coupler bridge 110, and/or section 111 can be longer or shorter than section 112. In another embodiment, edge 1112 of section 111 can comprise peaks and/or valleys or could be otherwise not continuous, such that height 1111 could vary along the length of coupler bridge 110. Similarly, edge 1122 of section 112 can comprise peaks and/or valleys or could be otherwise not continuous such that height 1121 could vary along the length of coupler bridge 110. In at least some embodiments, coupler bridge 110 can be referred to as a structure, edge 1112 and/or 1122 can be referred to as borders, and the length of coupler bridge 110 can be referred to as a dimension. Coupler bridge 110 can be manufactured out of one or more materials, including a plastic material and/or a rubber material, among others. Height 1121 can be substantially the same as or greater than the heights of couplers 1123-1124.

Coupler bridge 110 further comprises couplers 1123-1124 coupled to section 112. In the present example, couplers 1123-1124 are shown located at opposite ends of coupler bridge 110. In other examples, however, couplers 1123-1124 could be located elsewhere along section 112 away from the ends of coupler bridge 110. In some embodiments, couplers 1123-1124 can be referred to as connectors.

In the present embodiment, couplers 1123-1124 are shown as electrical terminals comprising at least one of quick-connect terminals and/or blade-connector terminals. For example, FIGS. 1-2 illustrate couplers 1123-1124 comprising FASTON® quick-connect terminals, which are commercially available from Tyco Electronics Corporation c/o The Whitaker Corporation in Washington, Del. As shown in FIG. 2, couplers 1123-1124 can be connected to wires 2131-2132, respectively, through a back side of coupler bridge 110, and wires 2131-2132 can be coupled to device contacts 291 of electrical device 290. In one embodiment, electrical device 290 can be an uninterruptible power supply. This arrangement allows electrical device 290 to be electrically coupled through wires 2131-2132 and via couplers 1123-1124 to a device coupled to the front side of bridge 110, such as battery 210 shown in FIG. 2.

As illustrated in FIGS. 1-2, couplers 1123-1124 can be surrounded by insulation shells 1125-1126, respectively. Insulation shells 1125-1126 are configured to provide insulation to parts of couplers 1123-1124 meant to be electrically isolated. In the present embodiment, insulation shells 1125-1126 surround the sides of couplers 1123-1124, respectively, leaving the front and back of couplers 1123-1124 accessible for contact with, for example, battery 210 and wires 2131-2132. In a different embodiment, insulation shells 1125-1126 may substantially surround only three sides of couplers 1123-1124, respectively. In another embodiment, insulation shells 1125-1126 can be integral with section 112 of coupler bridge 110. In yet another embodiment, coupler bridge 110 can forego insulation shells 1125-1126 altogether.

As shown in the present embodiment, couplers 1123-1124 can comprise substantially the same dimensions. In another embodiment, however, couplers 1123 and 1124 can comprise different dimensions, such that one could be larger than the other. In the same or a different embodiment, coupler 1123 can comprise a first color, while coupler 1124 can comprise a second color.

As illustrated in FIG. 2, coupler bridge 110 of coupler system 100 is configured to couple with battery 210, where battery 210 comprises battery terminals 211-212 separated from each other by distance 214. In some embodiments, distance 214 can be referred to as a magnitude.

Battery terminals 211-212 protrude from the body of battery 210 and comprise polarities 2111-2121, respectively. In the present embodiment, polarity 2111 is positive while polarity 2121 is negative. In a different embodiment, polarity 2111 can be negative while polarity 2121 can be positive.

In some embodiments, battery terminal 211 can comprise the first color corresponding to coupler 1123 of coupler bridge 110, while battery terminal 212 can comprise the second color corresponding to coupler 1124. As an example, the first color can be red, while the second color can be black. In some examples, the first and second colors can correspond to polarities 2111 and 2121, respectively.

In embodiments where couplers 1123 and 1124 comprise different dimensions, as explained above, battery terminals 211 and 212 can also comprise corresponding different dimensions such that one would be larger than the other. In such embodiments, for example, coupler 1123 can be physically incompatible with battery connector 212, and/or coupler 1124 can be physically incompatible with battery connector 211.

As shown in FIG. 2, couplers 1123 and 1124 are separated from each other by distance 214 such that, when coupler bridge 110 is properly aligned with battery 210, coupler 1123 can couple to battery terminal 211 and coupler 1124 can couple to battery terminal 212. In addition, coupler 1123 is configured for polarity 2111 of battery terminal 211, while coupler 1124 is configured for polarity 2121 of battery terminal 212. In one example, coupler 1123 can be coupled via wire 2131 to electrical device 290 at a first one of device contacts 291 compatible with polarity 2111, while coupler 1124 can be coupled to electrical device 290 via wire 2132 at a second one of device contacts 291 compatible with polarity 2121.

Figure 3:
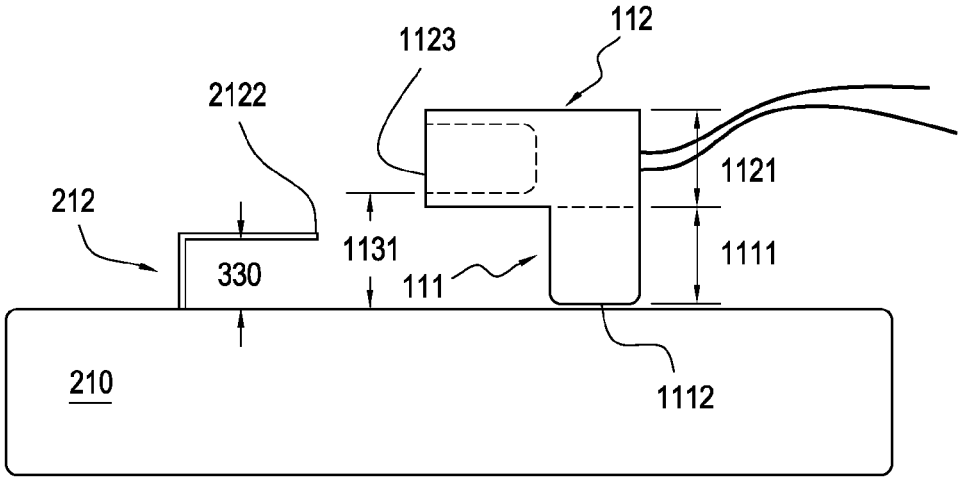
FIG. 3 illustrates a side view of the coupler bridge of FIG. 1 in a mis-aligned position with respect to the battery of FIG. 2.

Continuing with the figures, FIG. 3 illustrates a side view of coupler bridge 110 in a mis-aligned position with respect to battery 210. As shown in FIGS. 1-3, section 111 of coupler bridge 110 is configured to restrict couplers 1123-1124 from being electrically coupled to battery terminals 211-212 when edge 1112 of section 111 faces battery 210. In the present example, battery terminals 211-212 comprise terminal ends 2112 and 2122 positioned terminal height 330 over the body of battery 210. Height 1111 of section 111 is configured to position couplers 1123-1124 above terminal height 330 over the body of battery 210 when section 111 of coupler bridge 110 contacts the body of battery 210. Such a configuration allows height 1111 to elevate couplers 1123-1124 past terminal ends 2112 and 2122. Height 1111 of section 111 can be similarly configured to restrict coupler 1123 from coupling to battery terminal 212, and coupler 1124 from coupling to battery terminal 211, when edge 1112 faces battery 210. When edge 1112 contacts battery 210, couplers 1123-1124 can thus be aligned in an unconnectable position with respect to battery terminals 211-212.

In embodiments where couplers 1123-1124 do not abut section 111, elevation distance 1131 can be measured from edge 1112 of section 111 to at least one of couplers 1123 and 1124. In one example, elevation distance 1131 can be measured perpendicular to edge 1112. In some embodiments, elevation distance 1131 and/or height 1111 can be referred to as a breadth, respectively. Where elevation distance 1131 is configured to be greater than terminal height 330, couplers 1123-1124 will be elevated out of the range from terminal ends 2112 and 2122 when edge 1112 faces the body of battery 210.

Figure 4:
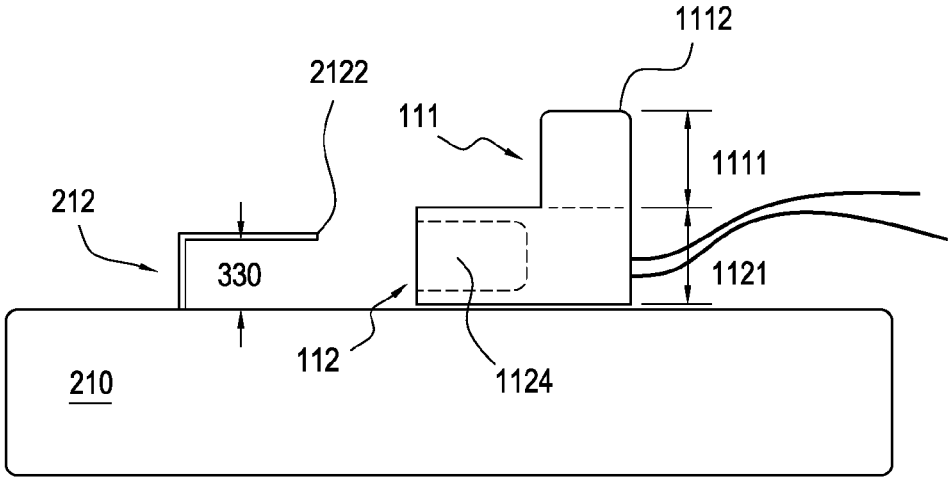
FIG. 4 illustrates a side view of the coupler bridge of FIG. 1 aligned to couple with the battery of FIG. 2.

Continuing with the figures, FIG. 4 illustrates a side view of coupler bridge 110 aligned to couple with battery 210. As illustrated by FIGS. 1, 2, and 4, height 1121 of section 112 is configured to permit coupler 1123 to couple to battery terminal 211, and to permit coupler 1124 to couple to battery terminal 212, only when edge 1122 of section 112 faces the body of battery 210. In particular, FIG. 4 illustrates that coupler 1123 is configured to align with and/or be coupled to battery terminal 211, and that coupler 1124 is configured to align with and/or be coupled to battery terminal 212, when edge 1112 of section 111 faces away from battery 210. In one embodiment, when section 112 of coupler bridge 110 contacts the body of battery 210, couplers 1123 and 1124 are positioned substantially at terminal height 330 over the body of batter 210, allowing coupler 1123 to couple to terminal end 2112, and coupler 1124 to couple to terminal end 2122.

Figure 5:
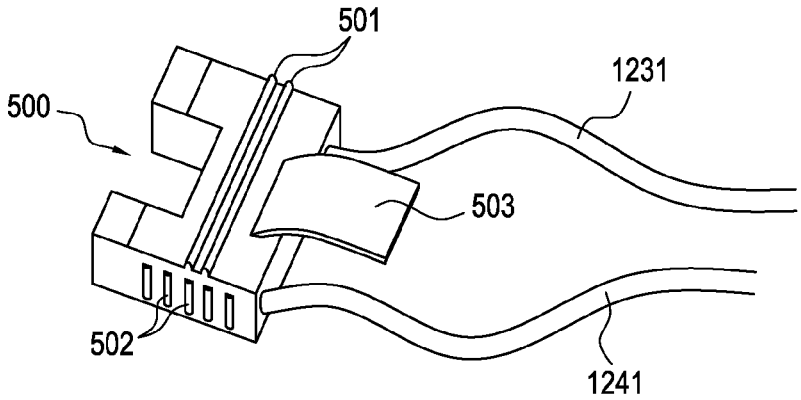
FIG. 5 illustrates an isometric view of a coupler bridge similar to the coupler bridge of FIGS. 1-4.

FIG. 5 illustrates an isometric view of coupler bridge 500. Coupler bridge 500 is similar to coupler bridge 110 of FIGS. 1-4, but comprises additional features to assist in the handling of coupler bridge 500. In the present example, coupler bridge 500 comprises one or more grip ridges 501 and 502 configured to provide an enhanced grip. The enhanced grip can be beneficial, for example, when coupling and/or decoupling coupler bridge 500 to battery 210 (FIGS. 2-4) similar to as described above for coupler bridge 110. In the present embodiment, grip ridges 501 are located at a top side of coupler bridge 500, and grip ridges 502 are located at one or more sides of coupler bridge 500. A bottom side of coupler bridge 500 can also have one or more ridges, and the ridges of coupler bridge 500 can be the same or different from each other. In one embodiment, only one or two sides of coupler bridge 500 have the ridges, and in another embodiment, all four sides of coupler bridge 500 have the ridges.

FIG. 5 also shows a pull-tab 503 coupled to the body of coupler bridge 500. Pull-tab 503 can be used, for example, to assist in coupling and/or decoupling coupler bridge 500 from battery 210 by pushing or pulling on pull tab 503 towards or away from battery terminals 211-212 (FIG. 2). In one embodiment, coupler bridge 500 has both the ridges and pull tab 503, and in another embodiment, coupler bridge 500 has only one of the ridges or pull tab 503.

Figure 6:
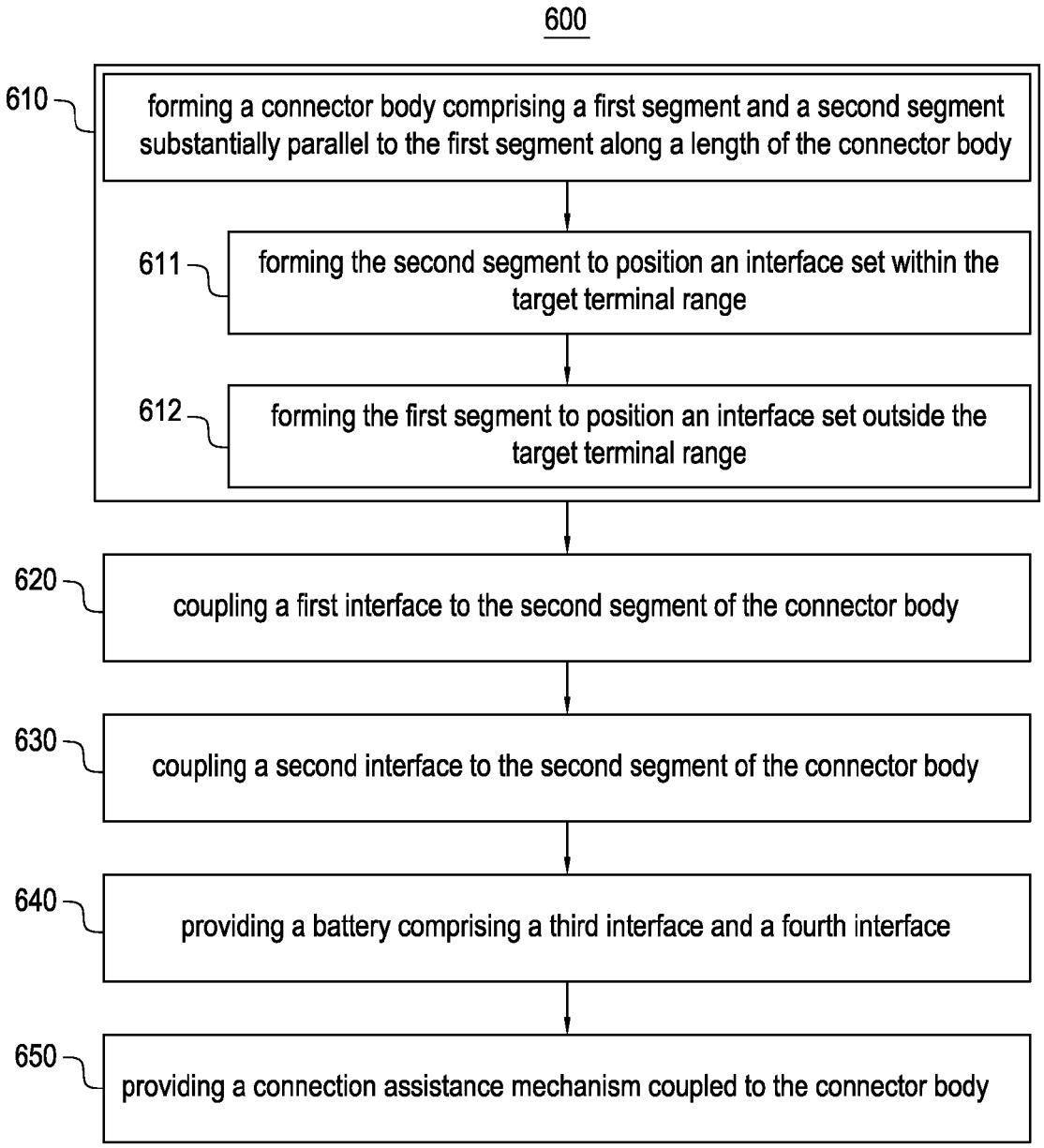
FIG. 6 illustrates a flowchart for a method of manufacturing an electrical connector for a target terminal range of a battery.

Continuing with the figures, FIG. 6 illustrates a flowchart for a method or manufacturing an electrical connector for a target terminal range of a battery. In some embodiments, the electrical connector can correspond to coupler bridge 110 (FIG. 1), while the target terminal range can correspond to terminal height 330 over battery 210 (FIGS. 3-4).

A block 610 of method 600 comprises forming a connector body comprising a first segment and a second segment substantially parallel to the first segment along a length of the connector body. In some embodiments, the first segment can be section 111 of coupler bridge 110 (FIG. 1), while the second segment can be section 112 of coupler bridge 110 lying parallel and/or adjacent to section 110 along a length of the connector body. Similar to coupler bridge 110, the connector body can comprise materials such as plastic and/or rubber. Additional details regarding block 610 are described below.

A block 620 of method 600 comprises coupling a first interface to the second segment of the connector body. As an example, the first interface can comprise coupler 1123 coupled to section 112 as described above for coupler bridge 110 (FIG. 1).

A block 630 of method 600 comprises coupling a second interface to the second segment of the connector body. As an example, the second interface can comprise coupler 1124 coupled to section 112, as described above for coupler bridge 10 (FIG. 1). In one embodiment, the first and second interfaces of the electrical connector of method 600 can be surrounded by insulation shells similar to as described above with respect to insulation shells 1125-1126 of coupler bridge 110 (FIG. 1). The sequence of blocks 620 and 630 can be reversed, performed simultaneously with each other, or performed simultaneously with block 610.

A block 640 of method 600 comprises providing a battery comprising a third interface and a fourth interface, wherein the third and fourth interfaces can extend from the battery to the target terminal range. As an example, the battery can be battery 210 (FIGS. 2-4), while the third and fourth interfaces can be battery terminals 211-212 (FIG. 2), respectively. The third and fourth interfaces can comprise interface ends, similar to terminal ends 2112 and 2122 (FIG. 2), located at one end of the target terminal range opposite the body of battery.

In one example, the third interface of the battery corresponds to the first interface of the electrical connector, while the fourth interface of the battery corresponds to the second interface of the electrical connector. To allow the respective interfaces to couple to each other, the third interface can be separated from the fourth interface by a terminal distance over the body of the battery, and the first interface can be separated from the second interface at the electrical connector by the same terminal distance. As an example, the terminal distance can be distance 214 (FIG. 2).

Returning to block 610 of method 600, a sub-block 611 of block 610 comprises forming the second segment of the electrical connector to position an interface set within the target terminal range, wherein the interface set comprises the first and second interfaces. In one embodiment, this configuration allows the electrical connector to facilitate the coupling of the first and second interfaces to the third and fourth interfaces of the battery, respectively, when the second segment faces the body of the battery and the respective interfaces are aligned relative each other. This scenario can be similar to as illustrated in FIG. 4 for coupler bridge 110 and battery 210, where height 1121 of section 112 is configured to position couplers 1123-1124 substantially at terminal height 330 in-line with terminal ends 2112 and 2122 when edge 1122 of section 112 faces towards and/or contacts the body of battery 210.

Remaining at block 610 of method 600, a sub-block 612 of block 610 comprises forming the first segment to position the interface set outside the target terminal range. In one embodiment, this configuration restricts the electrical connector from allowing the first and second interfaces to couple with the third and fourth interfaces when the first segment faces towards and/or contacts the body of the battery. This scenario can be similar to as shown in FIG. 3 for coupler bridge 110 and battery 210, where height 1111 and/or elevation distance 1131 can be configured to elevate couplers 1123-1124 outside the range of terminal height 330 and above terminal ends 2112 and 2122 when edge 1112 of section 111 faces towards and/or contacts the body of battery 210. Sub-blocks 611 and 612 can be performed in reverse sequence or simultaneously with each other.

Moving forward, a block 650 of method 600 comprises providing a connection assistance mechanism coupled to the connector body, wherein the connection assistance mechanism comprises at least one of one or more grip ridges, and/or a pull tab. In one example, the connection assistance mechanism can comprise grip ridges such as grip ridges 501-502 of coupler bridge 500 (FIG. 5). In the same or a different example, the connection assistance mechanism can comprise a pull tab such as pull tab 503 (FIG. 5). Similar to as explained above for coupler bridge 500 (FIG. 5), the connection assistance mechanism can be used to facilitate the coupling and/or decoupling of the electrical connector to the battery. In a different embodiment, block 650 can be part of block 610.

Although the invention has been described with reference to specific embodiments, it will be understood by those skilled in the art that various changes may be made without departing from the spirit or scope of the invention. For example, to one of ordinary skill in the art, it will be readily apparent that coupler bridge 110 (FIGS. 1-4) and/or battery 210 (FIGS. 2-4) can be used for different electrical devices or appliances other than uninterrupted power supplies, such as for automobiles, laptop computers, and/or emergency lights. In addition, although FIGS. 1-4 illustrate battery terminals 211 and 212 as tabs and illustrate couplers 1123-1124 as slots, a reverse situation can be possible where battery terminals could comprise slots and couplers for a corresponding battery terminal could comprise tabs.

Additional examples have been given in the foregoing description. Accordingly, the disclosure of embodiments of the invention is intended to be illustrative of the scope of the invention and is not intended to be limiting. It is intended that the scope of the invention shall be limited only to the extent required by the appended claims. To one of ordinary skill in the art, it will be readily apparent that the construction panel system and method of manufacture thereof discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A coupler system configured to couple to electrical terminals of a battery, the coupler system comprising:
- a coupler bridge comprising:
  - a first section comprising:
    - a first height; and
    - a first edge;
  - a second section adjacent to the first section and opposite the first edge, the second section comprising:
    - a second height; and
    - a second edge;
  - a first coupler coupled to the second section of the coupler bridge; and
  - a second coupler coupled to the second section of the coupler bridge;
- wherein:
  - the first and second edges are at opposite sides of the coupler bridge;
  - the electrical terminals of the battery comprise:
    - a first battery terminal with a first battery terminal end; and
    - a second battery terminal with a second battery terminal end;
  - the first and second battery terminal ends are positioned at a terminal height over a battery surface of the battery; and
  - when the first edge of the coupler bridge contacts the battery surface:
    - the first height of the first section is configured to position the first and second couplers past the terminal height over the battery surface to restrict the first and second couplers from being electrically coupled to the electrical terminals of the battery.

2. The coupler system of claim 1, wherein:
- the first coupler and the second coupler comprise at least one of:
  - quick disconnect terminals; or
  - blade-connector terminals.

3. The coupler system of claim 1, wherein:
- the first coupler and the second coupler are located at opposite ends of the coupler bridge.

4. The coupler system of claim 1, wherein:
- the first coupler is separated from the second coupler by a first distance; and
- the first battery terminal is separated from the second battery terminal by the first distance.

5. The coupler system of claim 1, wherein:
- the first coupler is larger than the second coupler.

6. The coupler system of claim 1, wherein:
- the first coupler is substantially surrounded by a first insulation shell; and
- the second coupler is substantially surrounded by a second insulation shell.

7. The coupler system of claim 1, wherein:
- the first coupler is configured for a first polarity; and
- the second coupler is configured for a second polarity.

8. The coupler system of claim 7, wherein:
- the first battery terminal is configured for the first polarity;

the second battery terminal is configured for the second polarity;

the first coupler is configured to be coupled to the first battery terminal when the first edge faces away from the battery; and the second coupler is configured to be coupled to the second battery terminal when the first edge faces away from the battery and while the first coupler is coupled to the first battery terminal.

9. The coupler system of claim 1, wherein:

the coupler bridge is configured to electrically couple an electric device to the battery while remaining distinct from and non-integral with the electric device.

10. The coupler system of claim 1, wherein:

the second height of the second section is configured to permit the first coupler to couple to the first battery terminal and the second coupler to couple to the second battery terminal only when the second edge faces towards the battery surface.

11. The coupler system of claim 1, wherein:

the first section comprises a first wall having the first height and extending between the second section and the first edge of the coupler bridge; and when the first wall contacts the first and second battery terminal ends while the first edge of the coupler bridge contacts the battery surface, the first and second couplers are positioned directly above the first and second battery terminals.

12. The coupler system of claim 1, wherein:

the first and second couplers are positioned substantially at the terminal height over the battery surface when the second edge of the coupler bridge contacts the battery surface.

13. The coupler system of claim 1, wherein:

the coupler bridge further comprises an elevation distance from the first edge of the first section to at least one of the first or second couplers; and the elevation distance is greater than the terminal height.

14. The coupler system of claim 1, wherein:

the coupler bridge comprises at least one of:

a plastic material; or a rubber material.

15. The coupler system of claim 1, wherein:

the coupler bridge further comprises at least one of:

one or more grip ridges; or a pull-tab.

16. The coupler system of claim 1, wherein:

the first coupler comprise a first color; and the second coupler comprise a second color.

17. The coupler system of claim 16, wherein:

the first battery terminal comprises the first color; and the second battery terminal comprises the second color.

18. A method of manufacturing an electrical connector for a target terminal range of a battery, the method comprising:

forming a connector body comprising a first segment with a first surface and a second segment with a second surface substantially parallel to the first surface along a length of the connector body;

coupling a first interface to the second segment of the connector body, the first interface being configured to couple to a first battery terminal end of a first battery terminal extending from a battery surface of the battery and located within the target terminal range over the battery surface;

and coupling a second interface to the second segment of the connector body, the second interface being configured to couple to a second battery terminal end of a second battery terminal extending from the battery surface and located within the target terminal range over the battery surface;

wherein the connector body is configured such that:

when the second surface of the second segment contacts the battery surface:

the first interface is positioned within the target terminal range to couple with the first battery terminal end; and the second interface is positioned within the target terminal range to couple with the second battery terminal end;

and when the first surface of the first segment contacts the battery surface:

the first and second interfaces are positioned outside the target terminal range to restrict the first and second interfaces from electrically coupling to the battery.

19. The coupler system of claim 1, wherein:

the coupler bridge comprises an L-shape such that:

a first leg of the L-shape is defined by the first section; and a second leg of the L-shape is defined by the second section;

and the second leg of the L-shape is longer than the first leg of the L-shape.

20. The method of claim 18, wherein:

the connector body is configured to electrically couple an electric device to the battery while remaining distinct from and non-integral with the electric device.

21. The method of claim 18, further comprising:

providing a connection assistance mechanism coupled to the connector body;

wherein the connection assistance mechanism comprises at least one of:

one or more grip ridges; or a pull-tab.

22. The method of claim 21, wherein:

providing the connection assistance mechanism occurs simultaneously with forming the connector body.

23. The method of claim 18, wherein:

coupling the first interface occurs simultaneously with coupling the second interface.

24. The method of claim 18, wherein:

forming the connector body comprises:

providing a second surface area of the second surface of the second segment to be greater than a first surface area of the first surface of the first segment; and providing the first section with a first wall extending between the second section and the first surface such that, when the first wall contacts the first and second battery terminal ends while the first surface contacts the battery surface, the first and second interfaces are positioned directly above the first and second battery terminals.

25. A battery connector mechanism for coupling with electrical terminals of a battery, the battery connector mechanism comprising:

a structure comprising:

a first section comprising a first border along a first dimension of the structure;

a second section adjacent to the first section and comprising a second border opposite the first border along the first dimension of the structure;

a first connector coupled to a first portion of the second section of the structure; and a second connector coupled to a second portion of the second section of the structure;

wherein:

the first section further comprises a first breadth;

the electrical terminals of the battery comprise a third connector and a fourth connector extending from a battery surface of the battery to a terminal height;

when the first border contacts the battery surface:

the first breadth is configured to position the first and second connectors above the third and fourth connectors such that the second section aligns the first and second connectors in an un-connectable position relative to the third and fourth connectors of the electrical terminals of the battery;

and when the second border contacts the battery surface:

the first connector is positioned at the terminal height over the battery surface for coupling with the fourth connector; and the second connector is positioned at the terminal height over the battery surface for coupling with the third connector.

26. The battery connector mechanism of claim 25, wherein:

the structure is configured to electrically couple an electric device to the battery while remaining distinct from and non-integral with the electric device;

the first and second connectors are located at substantially opposite ends of the structure;

the first connector is separated from the second connector by a first magnitude;

the third connector is separated from the fourth connector by the first magnitude;

the first and third connectors comprise a first polarity;

the second and fourth connectors comprise a second polarity;

the first breadth of the first section is configured to restrict both the first connector from coupling to the fourth connector, and the second connector from coupling to the third connector, when the first border contacts the battery surface; and the first and second connectors are configured to align with the third and fourth connectors only when the first border of the first section faces away from the battery surface.

27. The method of claim 18, wherein:

when the second surface of the second segment contacts the battery surface, the first segment is decoupled from the battery.

28. The battery connector mechanism of claim 25, wherein:

the first section comprises a first surface comprising the first border and a first surface area;

the second section comprises a second surface comprising the second border and a second surface area;

the second surface area is greater than the first surface area; and the first section comprises a first wall extending between the second section and the first surface such that, when the first wall contacts the third and fourth connectors while the first surface contacts the battery surface, the first and second connectors are positioned directly above the third and fourth connectors.

29. The coupler system of claim 1, wherein:

the first section comprises a first surface comprising the first edge and a first surface area;

the second section comprises a second surface comprising the second edge and a second surface area;

the second surface area is greater than the first surface area; and when the second edge of the coupler bridge contacts the battery surface, the first section is decoupled from the battery.

* * * * *